US005246216A

United States Patent [19]

Oberst

[11] Patent Number: 5,246,216

[45] Date of Patent: Sep. 21, 1993

[54] VISE JAW ATTACHMENT FOR IRREGULAR SHAPED WORKPIECES

[76] Inventor: E. Ernest Oberst, 404 Patton Dr., Cheshire, Conn. 06510

[21] Appl. No.: 969,479

[22] Filed: Oct. 30, 1992

[51] Int. Cl.[5] ..... B25B 1/24

[52] U.S. Cl. ..... 269/266; 269/275; 269/276; 269/274

[58] Field of Search ..... 269/22, 266, 275, 276, 269/274; 5/465, 449

[56] References Cited

U.S. PATENT DOCUMENTS

| | | | |
|---|---|---|---|
| 3,449,008 | 6/1969 | Colechia | 269/275 |
| 3,608,809 | 9/1971 | Cushman | 269/22 |
| 3,661,683 | 5/1972 | Engel et al. | 269/22 |
| 3,858,468 | 1/1975 | Pasbrig | 269/266 |
| 4,139,920 | 2/1979 | Evans | 5/465 |
| 4,353,537 | 10/1982 | Koufos | 269/266 |
| 4,569,511 | 2/1986 | Bell | 269/276 |
| 4,675,930 | 6/1987 | Clement | 5/465 |
| 4,754,511 | 7/1988 | Sargent | 5/449 |

*Primary Examiner*—Robert C. Watson
*Attorney, Agent, or Firm*—Chilton, Alix and Van Kirk

[57] ABSTRACT

An attachment is adapted for mounting to a jaw of a vise for use with clamping irregularly shaped workpieces. The attachment comprises a pouch of pellets which are variably displaceable to conform to the surface contour of the workpiece. The pouch is mounted against a plate which is adapted for mounting to a jaw of a vise.

24 Claims, 3 Drawing Sheets

VISE JAW ATTACHMENT FOR IRREGULAR SHAPED WORKPIECES

BACKGROUND OF THE INVENTION

This invention relates generally to devices for holding irregular shaped workpieces. More particularly, the present invention relates to vises which may be employed or adapted for irregular workpieces.

Irregular shaped workpieces have long presented problems when it is desired to clamp or hold such objects for work, repair or maintenance tasks. Conventional vises are often incapable of holding irregular shaped workpieces without either damaging the workpiece or unduly compromising the clamping integrity of the jaws. While some vises are constructed or modified by employing additional fixtures for specific irregular shaped workpieces, such modified vises are frequently not capable for effective use with a large spectrum of irregular shaped workpieces.

A number of devices and techniques have been proposed for adapting conventional vises and clamps for use with irregular shaped objects. Nagy U.S. Pat. No. 4,752,063 discloses a vise attachment which employs blade elements. The blade elements are relatively movable within a housing. Balls are mounted behind the elements for distributing various pressures exerted on the blades. Koufos U.S. Pat. No. 4,353,537 discloses a clamping device which employs various layers of balls including various spring biased balls for retaining irregularly shaped objects to a clamp. Philips U.S. Pat. No. 2,666,352 discloses a vise jaw faceplate which employs a magnetic insert for retaining the faceplate to the vise jaws.

Other patents which disclose devises to which the invention relates are set forth by Patentee and the U.S. Patent Number below:

| Patentee | U.S. Pat. No. |
|---|---|
| N. Barowsky | 2,658,415 |
| C. R. Peterson | 2,754,708 |
| W. Spanhel et al | 2,815,051 |
| P. W. Weiser | 3,318,594 |
| Robert Gault | 3,604,700 |
| Pasbrig | 3,858,468 |
| Thyberg et al | 4,047,709 |
| Pasch | 4,252,305 |

BRIEF SUMMARY OF THE INVENTION

Briefly stated, the invention in a preferred form is an attachment adapted for use with a jaw of a vise so that the vise may be adapted for irregular shaped workpieces. The attachment comprises a pouch which houses a multiplicity of pellets. Pellets are variably positionable within the pouch and are readily transformable to irregular multiple layer configurations. A mounting sub-assembly is employed for removably mounting the pouch to a jaw of a vise. Preferably, an attachment is mounted to each of the jaws of the vise. As the jaw is moved toward a clamping engagement with a received irregular shaped workpiece, the pellets within the pouches are displaced to generally conform to the shape of the engaged portions of the received workpiece.

The vise attachments may further comprise a support plate. The plate is affixed to the jaws and may be mounted to the jaws by magnets, adhesive or by a clip.

The pellets within the pouch may be uniformly sized hardened spheres, soft balls or various other objects.

An object of the invention is to provide a new and improved attachment for a vise jaw to thereby adapt the vise for irregularly shaped workpieces.

Another object of the invention is to provide a new and improved vise jaw attachment which may be efficiently mounted to the jaws of a conventional vise and efficiently dismounted therefrom.

A further object of the invention is to provide a new and improved attachment for a vise which adapts the vise for clamping an irregularly shaped workpiece in an engagement having a high holding integrity without damaging the workpiece.

Other objects and advantages of the invention will become apparent from the detailed drawings and the specification.

DETAILED DESCRIPTION OF THE PREFERRED EMBODIMENT

Figure 1:
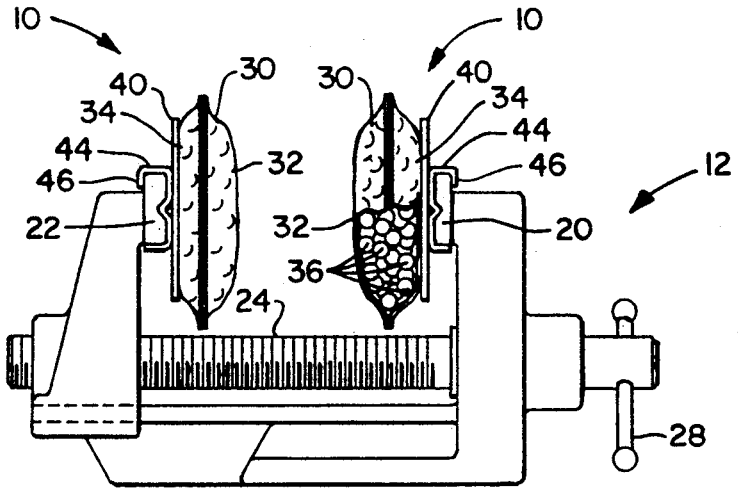
FIG. 1 a side elevational view of a vise incorporating two vise attachments in accordance with the present invention, a portion of one vise attachment being broken away.

With reference to the drawings wherein like numerals represent like parts throughout the several figures, a pair of vise jaw attachments 10 in accordance with the present invention are adapted for use in conjunction with a clamping apparatus or vise designated generally by the numeral 12. Each attachment 10 is adapted for efficient mounting to a conventional vise so that the vise may provide a clamp of high integrity against a received irregular shaped workpiece without damaging the workpiece. A prototypical irregular shaped workpiece for purposes of illustrating the invention is designated by the numeral 14 in FIG. 3.

Vise 12, except for the attachments described herein, may be of conventional form and function. The illustrated vise 12 includes a pair of opposed cooperating jaws 20 and 22. The spacing and clamped relationship between the jaws is implemented by a worm drive 24 which threads with the moveable jaw 22. The spacing between the jaws is varied by merely rotating the sliding lever handle 28. Vise 12 may, for example, be a conventional vise employed by a machinist, a jeweler, a hobbyist or another individual who desires to hold a workpiece in a stable fixed position. In preferred application, an attachment 10 is mounted to each of the opposing jaws 20 and 22.

Figure 9:
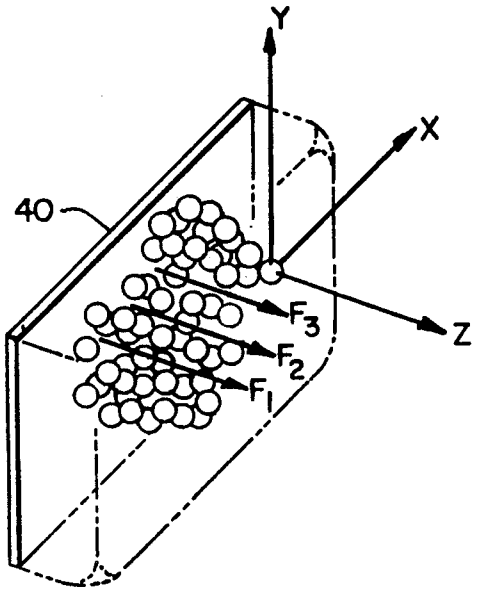
FIG. 9 is a schematic representation of the transformable feature of a vise attachment of FIG. 1.

Attachment 10 comprises a pouch 30 which may be manufactured from plastic, leather, cloth or other suitable materials. Pouch 30 is composed of a transparent or semi-transparent material in the drawings for purposes of illustration. The pouch 30 has opposed frontal and rear panels 32, 34. The pouch 30 contains numerous substantially identical pellets 36. The pouch is not completely filled with pellets so that a significant possible unoccupied volume within the flexible pouch will allow for movement of the pellets. The pouch is flexible and has a nominal thickness which exceeds several multiples of the maximum diameters of the pellets. As will be described below, the composition of the pellets 36 and their dimensions may be selected for a given application for attachment 10. For vise attachment 10, the pellets are hardened spheres having substantially uniform diameters. The spherical pellets 36 are positionable and variably displaceable within the pouch in three dimensional XYZ transformations as illustrated in FIG. 9 to form transformable but temporarily stable multiple layers within the pouch. In short, the pellets 36 are positionable so that when a workpiece is forced against the frontal panel 32 and a suitable compressive force is applied between the pouch and the workpiece, the pellets will displace to approximately conform to the contours of the engaged portion of the irregular workpiece.

Figure 2:
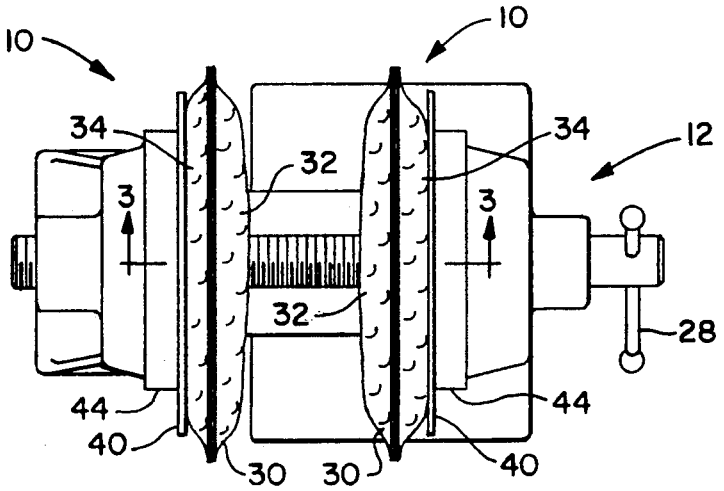
FIG. 2 is a top plan view of the vise and attachments of FIG. 1.
Figure 3:
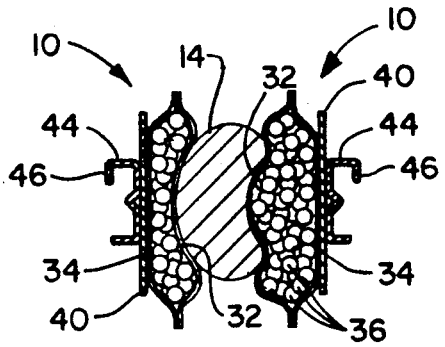
FIG. 3 is a side sectional view of the vise attachments and a clamped irregular shaped workpiece, said attachments view taken along the line 3—3 of FIG. 2.
Figure 4:
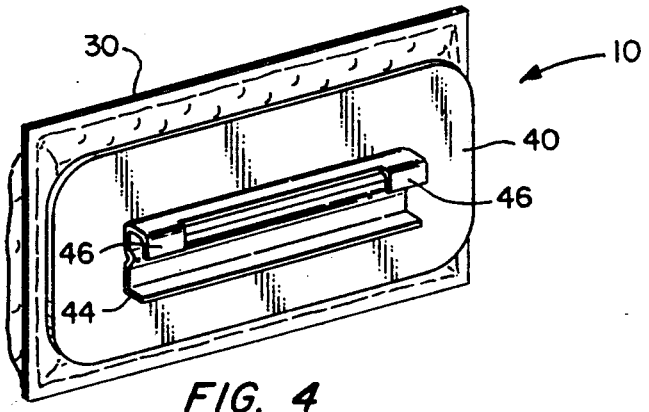
FIG. 4 is a rear perspective view of one of the attachments of FIG. 1.

The pouch is mounted to a compression plate 40 by means of an adhesive or other suitable means so that a substantial portion of the rear panel 34 engages the plate in surface-to-surface relationship. These compression plates are mounted to the vise jaws plates by various convenient means, depending upon the configuration of the vise and the jaws and their composition, i.e., whether magnetic or non-magnetic. In FIGS. 1-3, to hold the compression plates on this particular vise shown, a mounting clip 44 is fastened to the back of the compression plate. Clip 44 has a quasi U-shaped section with an upper retainer flange 46 which closely conforms to the contour of the jaw. The clip 44 has at least one open end to allow for the clip to be laterally slid onto the jaw (in the direction of the FIG. 2 arrow) for purposes of mounting the attachment to the jaw. The retainer flange 46 provides a high degree of mounting integrity between the attachment and the jaw. It should be appreciated that the attachment may be readily dismounted by reversing the sliding displacement of the clip.

As illustrated in FIGS. 1 through 3, identical attachments 10 are preferably mounted to each of the opposing jaws 20, 22 so that the engaging panels 32 of the pouches are oriented in facing relationship. The irregular shaped object 14 is positioned between the attachments. Upon the clamping engagement of the vise, the pellets 36 in the pouch are displaced to a stable transformed matrix so as to approximately conform to the adjacent surface contours of the workpiece. With reference to FIG. 9 the pellets are capable of three dimensional sliding displacement within the pouch. A compressive force exerted against the frontal panel 3 parallel to the axis is transferred through the pellets and is ultimately exerted against the plate 40. The applied forces result in a cascading sliding displacement of the pellets having possible X, Y and Z components. The compressive force of the vise jaws transmitted through the pellets to the workpiece. Once the transformed pellet configuration mirroring the contour of the engaged workpiece portion is attained, the vise clamping forces are efficiently transferred via the stable pellet stacks to exert a substantially uniform holding force, F1, F2, F3, . . . on the workpiece. It will be appreciated that in the FIG. 3 orientation, the irregular workpiece may be retained under a clamping load of high integrity without the clamp engagement structures damaging the workpiece.

Figure 6:
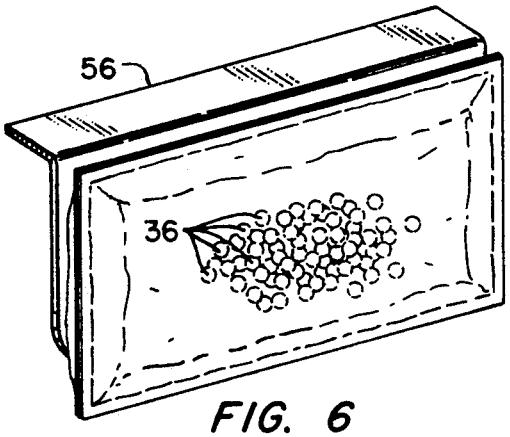
FIG. 6 is a frontal view of the vise attachment of FIG. 5.
Figure 7:
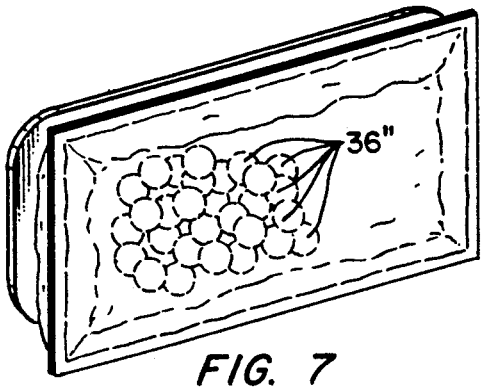
FIG. 7 is a frontal view of a third embodiment of a vise attachment in accordance with the present invention.

The pellets 36 may be hard balls, BBs, or for some applications, may be manufactured from softer more resilient materials, such as plastic or foam balls. Powdered lubricant, such as a Teflon material, may be applied to the pellets to facilitate the sliding displacement of the pellets upon application of the clamping force. One pair of attachments may employ hard pellets and another pair of attachments may employ soft pellets. Specific attachments can then be selected in accordance with the structural fragility or rigidity of the workpiece. Likewise, the dimensions of the pellets may be selected in accordance with a given application as illustrated by the contrast between the BB pellets 36' of FIG. 6 and the larger diameter plastic balls 36'' illustrated in FIG. 7. The pouch in some embodiments may contain two or more sizes of pellets.

Figure 5:
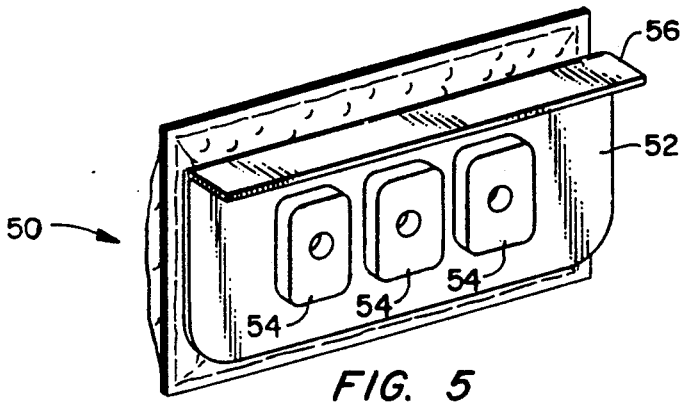
FIG. 5 is a rear perspective view of a second embodiment of a vise attachment in accordance with the present invention.

With reference to FIG. 5, a second embodiment of the attachment in accordance with the present invention is generally designated by the numeral 50. Attachment 50 employs a pouch 30 containing pellets 36'. The pouch is mounted to a metal support plate 52 by an adhesive such as regular household glue or double sided adhesive tape. When once positioned on the plate, the pouches are not subjected to any substantial forces to cause them to shift in their alignment opposite to each other. The fixed relationship of the attachments is enhanced as the vise jaws press against the workpiece. A less permanent adhesive may be used if it is desirable to enable pouches on the plates 52 to be changed. Magnets 54 are mounted to the back of the support plate by an adhesive such as apoxy glue; however, adhesive magnetic strips may be used in lieu of cementing one or more magnets as shown.

Attachment 50 is mounted to the jaws of the vise by merely magnetically attaching the jaws to the vise. A retaining flange 56 integrally extends generally perpendicularly away from the plate at the top. The flange 56 is engageable against the top of the jaws to facilitate quick positioning and alignment of the attachments opposite each other and also so the attachments do not disengage from the jaws under a downward sliding shear-type force. Another feature of the flange 56, is to enable the attachment 50 to become easily centrally positioned on different vises whose jaw sets 20 and 22 may vary in dimensions and distances above their worm drives 24. This is accomplished by varying the position of the flange 56 (up or down) to selectively pre-establish a reference contact with the tops of the jaws.

Figure 8:
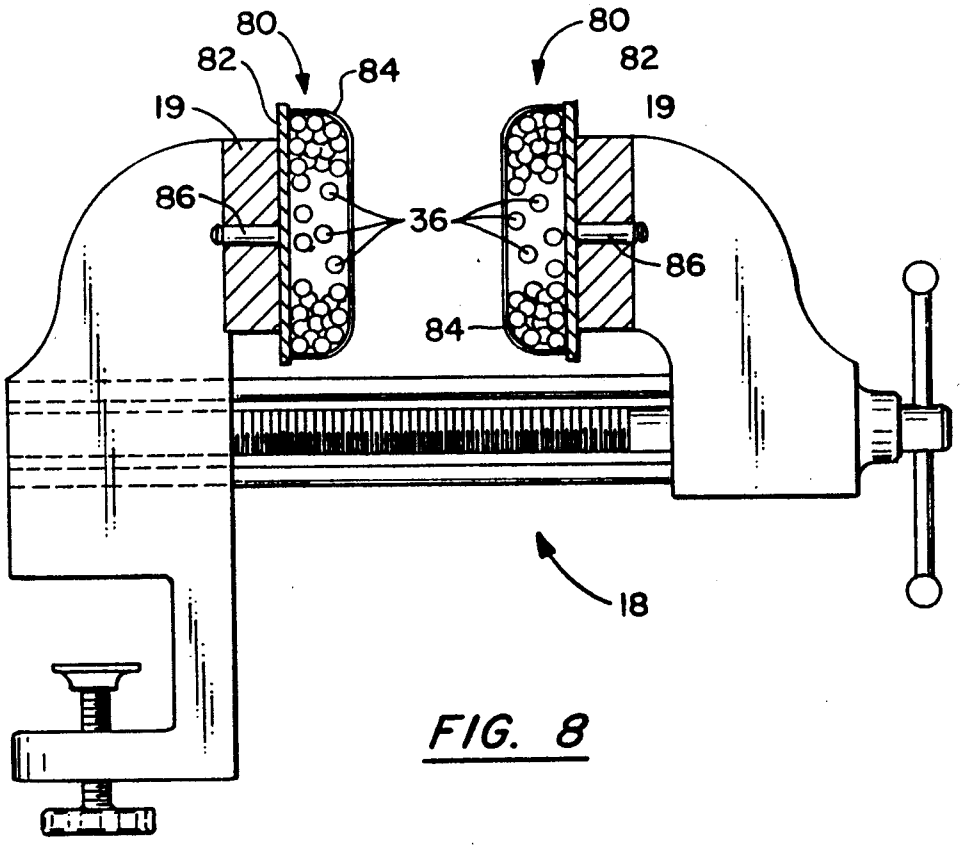
FIG. 8 is a side elevational view, partly in section, partly broken away and partly in schematic, illustrating a vise and a fourth embodiment of vise attachments in accordance with the present invention.

With additional reference to FIG. 8, vise 18 employs an attachments 80 which differ from the previously described attachments 10 and 50 in terms of the structure for housing the pellets and the structure attaching the attachment to the vise jaws 19. The plate 82 also functions as a rear enclosure panel for the pouch 84. The attachment structure includes a pair of opposed resilient spring clips 86 which are biased so that they spring against the backside of the jaws 19 to hold the attachments to the jaws. It will be appreciated that under ordinary clamping conditions, application of the clamping force to a workpiece disposed between the attachments also functions to retain the attachments to the jaws in a clamping relationship.

It will be appreciated that the attachments 10, 50 and 80 provide the means wherein the pressure exerted by the opposed jaws of the vise is distributed over a substantial surface area of the irregular shaped workpiece so that the exertion of significantly different holding pressures to different areas of the workpiece is reduced, thereby reducing any tendency of the irregular shaped workpiece to disengage from the clamping engagement. In addition to the substantially more uniform pressure distribution against the clamped object or workpiece, the pouch and the pellets function to provide a cushioning-type clamping engagement so as to minimize, if not prevent, any damage to the surface or structure of the clamped workpiece.

While a preferred embodiment of the foregoing invention has been set forth for purposes of illustration, the foregoing invention should not be deemed a limitation of the invention herein. Accordingly, various modifications, adaptations and alternatives may occur one skilled in the art without departing from the spirit and the scope of the present invention.

What is claimed is:

1. A vise for irregular shaped workpieces comprising:

vise means comprising a pair of opposing jaws and clamp means for clamping said jaws against a workpiece disposed therebetween;

pouch means for forming a pouch having a frontal panel;

pellet means comprising a multiplicity of pellets contained in said pouch means and variably positionable therein so that the surface of the pouch generally conforms to a surface portion of an irregular shaped workpiece forced against said frontal panel; and mounting means for removably mounting said pouch means to a said jaw.

2. The vise of claim 1 further comprising a plate, said pouch mounted against said plate wherein said plate is spaced from said pouch means frontal panel, and said mounting means being affixed to said plate.

3. The vise of claim 2 wherein said mounting means comprises at least one magnet.

4. The vise in claim 2 wherein said mounting means comprises a clip.

5. The vise of claim 2 wherein said mounting means comprises a clip defining a transverse channel and including a retainer lip for slidably mounting to a said jaw.

6. The vise of 1 wherein said pellet means comprises hardened spheres.

7. The vise of 1 wherein said pellet means comprises soft spheres.

8. The vise of claim 1 wherein said pellets are plastic balls.

9. The vise of claim 1 further comprising a lubricating material applied to said pellets to facilitate sliding displacement thereof.

10. The vise of claim 2 further comprising a retaining flange projecting generally perpendicularly from said plate.

11. The vise of claim 1 further comprising:

second pouch means for forming a second pouch having a second frontal panel;

second pellet means comprising a second multiplicity of pellets contained in said second pouch means and variably positionable therein; and second mounting means for removably mounting said second pouch means to the other jaw.

12. An attachment for a jaw of a vise comprising:

pouch means comprising a pouch having a first flexible panel and an opposed second panel;

pellet means comprising a multiplicity of pellets contained in said pouch, said pellets being variably positionable by three dimensional displacement relative to each other within said pouch to form transformable stacks extending between said a first and second panels and having variable thicknesses;

a support plate mounted to one side of said pouch so that said second panel and said plate engage in surface to surface relationship; and mounting means fixed to said support plate for mounting said attachment to the jaw of a vise.

13. The attachment of claim 12 wherein said mounting means comprises at least one magnet mounted to said support plate.

14. The attachment of claim 12 wherein said mounting means comprises a clip having a longitudinal channel adapted to slip over and slidably mount onto a jaw.

15. The attachment of claim 12 wherein said pellets are hardened spheres of substantially uniform dimension.

16. The attachment of claim 12 wherein said pellets are soft spheres of substantially uniform dimension.

17. The attachment of claim 12 wherein said pellets are plastic balls.

18. The attachment of claim 12 further comprising a lubricating material applied to said pellets to facilitate sliding displacement thereof.

19. The attachment of claim 18 wherein said lubricating material is a powder.

20. An attachment for a jaw of a vise comprising:

support plate means having first and second sides;

pouch means mounted to said first side and having a frontal panel spaced from said first side;

pellet means comprising a multiplicity of pellets contained in said pouch means and variably displaceable therein so that an irregular shaped workpiece forced against said frontal panel forces said pellets toward said plate means and said pellets are transformed into a configuration having a variable transverse thickness which approximately conforms to the contour of the engaged portion of the workpiece, and said pellet configuration is sufficiently stable to transfer a compressive force from said plate means to a substantial engagement interface of said workpiece; and jaw mounting means affixed to said plate means for mounting said plate means to said jaw.

21. The attachment of claim 20 wherein said pellets are substantially identical spheres.

22. The attachment of claim 20 wherein said jaw mounting means comprises a magnet.

23. The attachment of claim 20 further comprising a retaining flange extending generally perpendicular to said support plate means.

24. The attachment of claim 20 wherein said pellets are substantially identical plastic balls.

* * * * *